US008337438B2

(12) United States Patent
Schupman

(10) Patent No.: US 8,337,438 B2
(45) Date of Patent: Dec. 25, 2012

(54) METHOD AND DEVICE FOR RELIEVING MUSCLE TENSION

(76) Inventor: Mark Schupman, Hays, KS (US)

( * ) Notice: Subject to any disclaimer, the term of this patent is extended or adjusted under 35 U.S.C. 154(b) by 469 days.

(21) Appl. No.: 12/639,689

(22) Filed: Dec. 16, 2009

(65) Prior Publication Data

US 2010/0152632 A1 Jun. 17, 2010

Related U.S. Application Data

(60) Provisional application No. 61/122,827, filed on Dec. 16, 2008.

(51) Int. Cl.
*A61H 7/00* (2006.01)

(52) U.S. Cl. ..... 601/135; 604/134; 604/15

(58) Field of Classification Search ..... 601/15, 601/134, 135, 111; D24/200, 211, 215
See application file for complete search history.

(56) References Cited

U.S. PATENT DOCUMENTS

| | | | |
|---|---|---|---|
| 5,560,746 | A | 10/1996 | Willow |
| 5,683,352 | A | 11/1997 | Watts |
| 6,261,251 | B1 | 7/2001 | Meyers |
| 6,988,997 | B2 | 1/2006 | Stultz |

OTHER PUBLICATIONS

Body Back Buddy, Jun. 18, 2008, http://www.bodyback.com/Massagers-By-Type/Trigger-Point-Massagers.html.

*Primary Examiner* — Laura Bouchelle
(74) *Attorney, Agent, or Firm* — Erickson, Kernell, Derusseau & Kleypas, LLC

(57) ABSTRACT

A method and device for relieving muscle tension and spasms in a user's head, neck, shoulders and back is provided. The method and device may be used by an individual to apply pressure to specific pressure points on the trapezius muscles of the user's shoulders, sub-occipital area of the user's neck and rhomboid and thoracic paraspinal region of the user's back.

11 Claims, 2 Drawing Sheets

METHOD AND DEVICE FOR RELIEVING MUSCLE TENSION

CROSS REFERENCE TO RELATED APPLICATION

This application claims the benefit of co-pending provisional application Ser. No. 61/122,827, filed Dec. 16, 2008, entitled METHOD AND DEVICE FOR RELIEVING MUSCLE TENSION.

FIELD

The present invention relates to a method and device to relieve muscle tension and, more particularly, to a manual device to apply pressure to specific areas on a person's head, neck, shoulder and back regions to relieve muscle tension.

BACKGROUND

Various personal massage devices have been proposed to allow a person to apply pressure or a vibrating massage to the person's own neck or back. Many of these devices include a handle for gripping by the person, extending into an elongated J-shaped curved extension to reach the person's own back. The end of the curved extension may include a rounded end or vibrator device to apply pressure or a massage to difficult-to-reach locations on the person's own back. Other types may be used for self-application of acupressure by the user.

While these devices provide access to various spots on the person's own back, they often are not effective in relieving muscle tension because the user does not have the necessary training to apply the pressure or massage to the right areas. Further, in order to effectively relieve tension, more than one location on a person's back and/or neck may need to be accessed and massaged at the same time.

SUMMARY

The present invention provides a method and device which may be used by an individual to relieve muscle tension and spasms in their head, neck, back and shoulders. The device includes a body and three pairs of outwardly extending arms with tips for engaging the wearer. A first pair of arms with anterior tips extend and hook over the user's shoulders. A second pair of arms with superior tips extend from a flexible neck connected to the body to apply direct pressure to the sub-occipital area of the user's neck. A third pair of arms with inferior tips apply pressure to the user's rhomboid and thoracic paraspinal region. A user hooks the first pair of arms with anterior tips over his or her trapezius muscles then leans his or her head back to apply direct pressure to the sub-occipital area of the user's neck through the superior tips on the second pair of arms. The force is transferred through the body and third pair of arms to the inferior tips to apply pressure to the rhomboid and thoracic paraspinal region. Pressure may be held for a brief period until the user feels the hyper-tonic muscles relax. The application of pressure may be repeated several times until relief is achieved.

DETAILED DESCRIPTION

Figure 1:
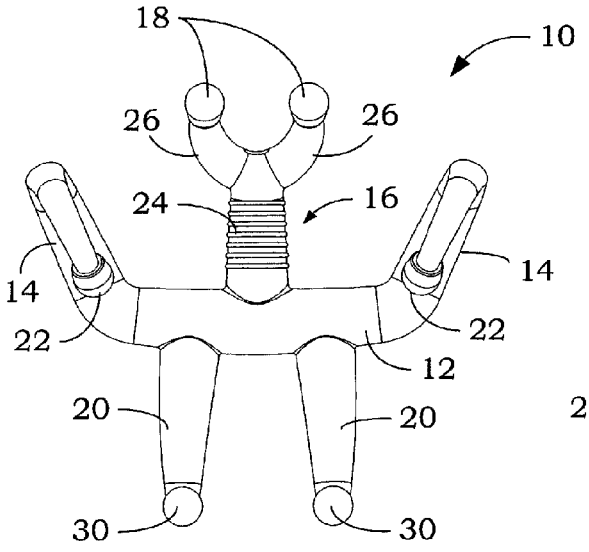
FIG. 1 is a front elevational view of a device for relieving muscle tension.
Figure 3:
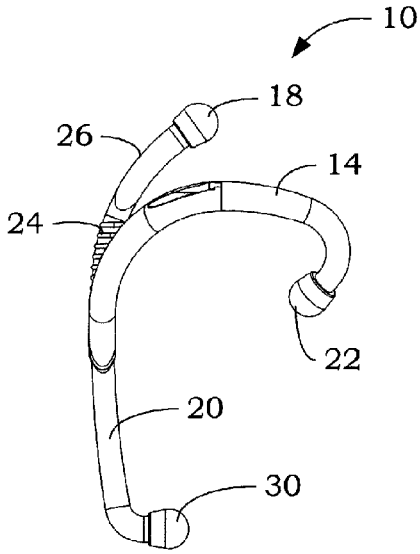
FIG. 3 is a side elevational view of the device of FIG. 1.
Figure 2:
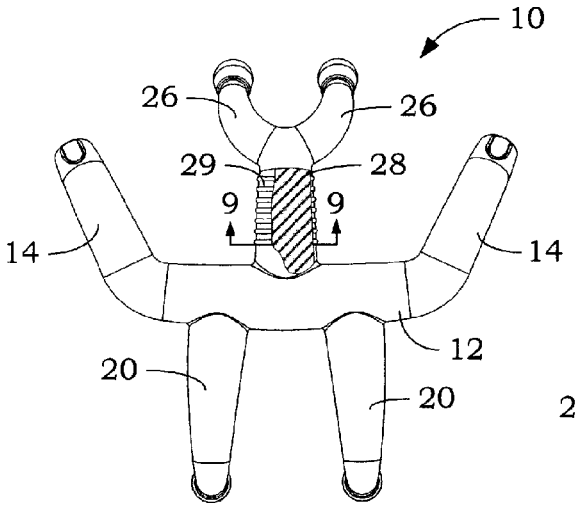
FIG. 2 is a rear elevational view of the device of FIG. 1 with portions removed to show detail thereof.
Figure 6:
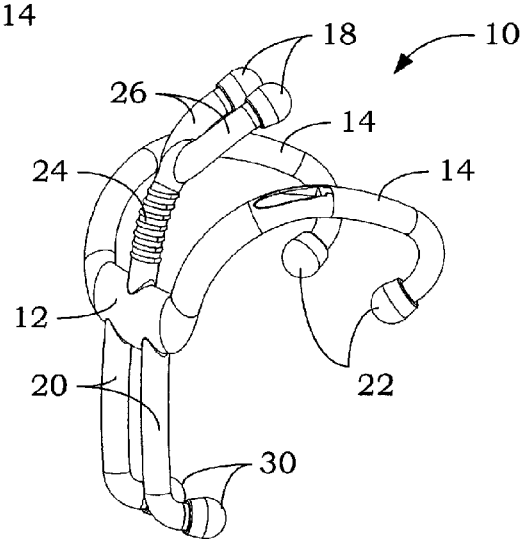
FIG. 6 is a perspective view of the device of FIG. 1.
Figure 4:
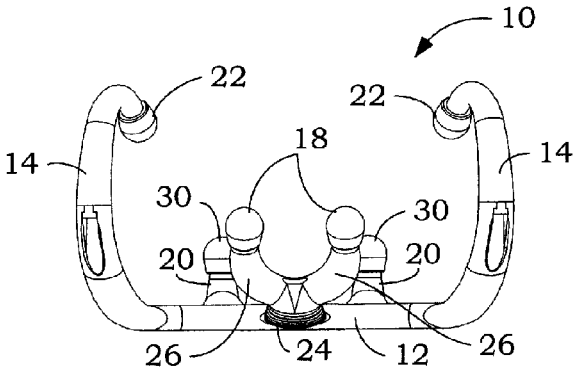
FIG. 4 is a top plan view of the device of FIG. 1.

Referring to the figures, a muscle tension relieving device is generally indicated by reference numeral 10. The muscle tension relieving device 10 includes a body 12, a first pair of arms 14 which are generally J-shaped, a neck portion 16 with a second pair of spaced-apart arms 17 having superior tips 18 and a third pair of arms or legs 20.

The arms 14 extend outwardly and upwardly from the body 12 and each terminate with an anterior tip 22. The arms 14 are shown as generally J-shaped, forming hooks, to loop over the user's shoulders so that the anterior tips 22 contact the user's trapezius muscles. The J-shape of the arms 14 shown in the figures accommodates many different user body types and sizes without contacting the user's shoulders or back except at the anterior tips 22. It should be understood that other shapes may be used. Further, the length of arms 14 may be adjustable to accommodate different user body sizes.

Figure 9:
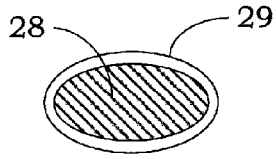
FIG. 9 is a cross-sectional view of the device taken along line 9-9 of FIG. 2.
Figure 5:
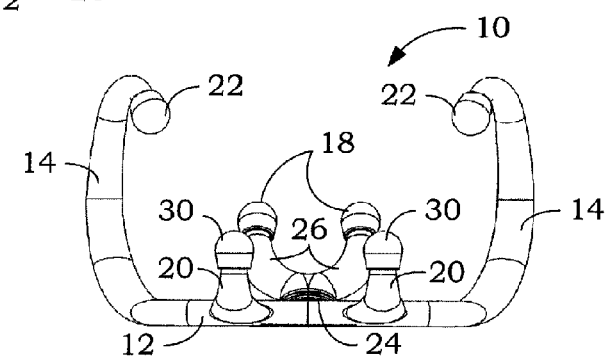
FIG. 5 is a bottom plan view of the device of FIG. 1.
Figure 7:
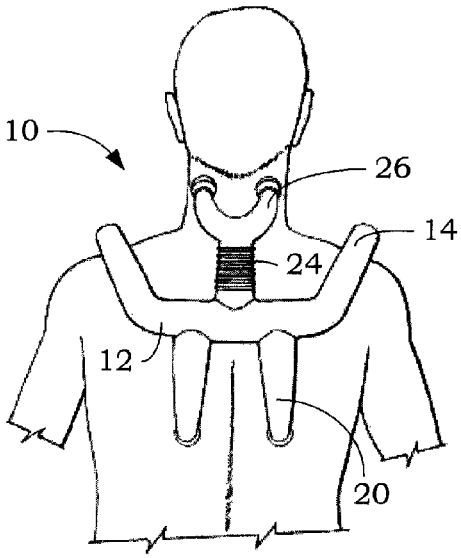
FIG. 7 is a rear elevational view of the device of FIG. 1 shown in use.
Figure 8:
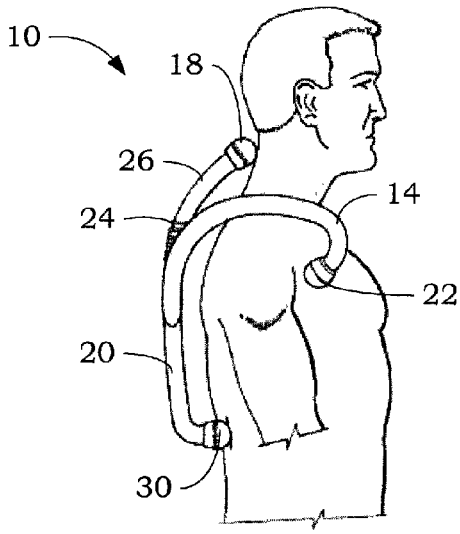
FIG. 8 is a side elevational view of the device of FIG. 1 shown in use.

The neck portion 16 includes a flexible coupling 24 between the body 12 and the second pair of arms 26. The flexible coupling 24 may be formed from a resilient plastic or rubber piece 28 curved to project forward, a bowed piece of spring steel (not shown), or a spring (not shown) enclosed by a flexible sheath 29 (See FIG. 9). The neck portion may also be described as a flexible neck. The neck portion 16 extends upwardly from the body 12 and projects forward to position the superior tips 18 so that they may contact the user's neck on both sides of the user's spine. The superior tips 18 are positioned to apply direct pressure to the sub-occipital area of the user's neck.

Legs 20 extend downwardly and inwardly from the body 12 and terminate at inferior tips 30 which project forward. The tips 30 are spaced apart to be positioned to contact the user's rhomboid and thoracic paraspinal region on both sides of the user's spine. Although shown as separate legs 20 in the figures, a single trunk (not shown) may extend downwardly from body 12 and split into the pair of legs with inferior tips 30 in a similar configuration as shown for the neck 16 and second pair of arms 26 with tips 18.

The muscle tension relieving device 10 may be made of plastic by injection molding, gas assist injection molding or other appropriate material and/or fabrication method. The pieces may be fabricated separately and snapped, glued or otherwise assembled together, for example.

The tips 18, 22 and 30 may be fabricated of a soft rubber material or may be made of a hard smooth plastic or combination thereof, for example. It may be advantageous to fabricate tips 18 from a hard smooth material to allow the tips to easily slide along the user's neck during use while the other tips 22 and 30 may be fabricated from a soft rubber material with a relatively high coefficient of friction to help hold the tips in place against the user's body or clothing.

One or more pair of the tips 18, 22 and/or 30 may include a vibrator and/or heat source such as, for example, an infrared heat source. Power to the tips may be individually controllable by the user.

In use, the user places the anterior tips 22 over his/her shoulders. The muscle tension relieving device 10 naturally centers itself on the user's back. Next, the user leans his or her head back to apply pressure from the superior tips 18 to the sub-occipital area of the user's neck. The flexible neck 16 generally functions as a lead spring or bowed spring and normally biases the upper arms 26 and legs 20 forward to engage the user's neck and back, respectively. As the user leans his or her head backwards, neck 16 flexes rearward while still exerting pressure through the tips 18 and against the user's neck. The spring force may also be transferred from the superior tips 18 through the neck 16 and body 12 to the legs 20 and inferior tips 30. The inferior tips 30 then may apply pressure to the rhomboid and thoracic paraspinal region of the user's back. The force may also be transferred from the superior tips 18 through the neck 16 and body 12 to the arms 14 and anterior tips 22 to apply pressure to the trapezius muscles. Constant pressure may be applied for thirty seconds to one minute, or until the user feels relaxation in the hypertonic muscles. This process may be repeated one or more times until the tension is relieved.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A device to relieve muscle tension in a user's head, neck, back and/or shoulders comprising:

a body having an upwardly extending flexible neck;

a first pair of arms extending outwardly and upwardly from said body, each having an anterior tip;

a second pair of arms extending upwardly from said flexible neck, each having a superior tip, and a pair of legs extending downwardly from said body, each having an inferior tip;

said first pair of arms each having a generally J-shape forming hooks adapted to loop over the user's shoulders, said anterior tips contacting the user's trapezius muscles;

said second pair of arms forming a generally U-shape, said superior tips contacting the sub-occipital area of the user's neck on each side of the user's spine;

said pair of legs each having a generally L-shape, said inferior tips contacting the user's rhomboid and thoracic paraspinal region on each side of the user's spine.

2. The device of claim 1 wherein said inferior, anterior and superior tips are generally spherically shaped.

3. The device of claim 1 wherein said inferior, anterior and superior tips are fabricated of a soft rubber material.

4. The device of claim 1 wherein one or more of said inferior, anterior or superior tips include a vibrator.

5. The device of claim 1 wherein one or more of said inferior, anterior or superior tips include a heat source.

6. A device to relieve muscle tension in a user's head, neck, back and/or shoulders comprising:

a laterally extending body;

a neck extending upwardly from said body;

a pair of legs extending downwardly from said body;

a first pair of arms extending upwardly and outwardly from opposite ends of said laterally extending body; and a second pair of arms extending outwardly and upwardly from said neck;

said pair of legs having a generally L-shape and each terminating at inferior tips extending forwardly, said inferior tips positioned to contact the user's rhomboid and thoracic paraspinal region on each side of the user's spine;

said first pair of arms having a generally inverted J-shape and each terminating at anterior tips extending rearwardly, said anterior tips positioned to contact the user's trapezius muscles without contacting the user's shoulders;

said second pair of arms together having a generally U-shape and each terminating at superior tips extending forwardly, said superior tips positioned to contact the sub-occipital area of the user's neck on each side of the user's spine.

7. The device of claim 6 wherein said neck is flexible.

8. The device of claim 6 wherein said inferior, anterior and superior tips are generally spherically shaped.

9. The device of claim 6 wherein said inferior, anterior and superior tips are fabricated of a soft rubber material.

10. The device of claim 6 wherein one or more of said inferior, anterior or superior tips include a vibrator.

11. The device of claim 6 wherein one or more of said inferior, anterior or superior tips include a heat source.

* * * * *